US011761158B2

(12) United States Patent
Baldi

(10) Patent No.: US 11,761,158 B2
(45) Date of Patent: Sep. 19, 2023

(54) VEHICLE BASED JOINT SEALING SYSTEM

(71) Applicant: Pasquale J Baldi, Beaumont, CA (US)

(72) Inventor: Pasquale J Baldi, Beaumont, CA (US)

( * ) Notice: Subject to any disclaimer, the term of this patent is extended or adjusted under 35 U.S.C. 154(b) by 0 days.

(21) Appl. No.: 17/490,203

(22) Filed: Sep. 30, 2021

(65) Prior Publication Data

US 2023/0101941 A1 Mar. 30, 2023

(51) Int. Cl.
*E01C 23/09* (2006.01)
*E01C 11/06* (2006.01)

(52) U.S. Cl.
CPC ..... *E01C 23/0973* (2013.01); *E01C 11/06* (2013.01)

(58) Field of Classification Search
CPC ..... E01C 11/06; E01C 23/0973
USPC ..... 404/111
See application file for complete search history.

(56) References Cited

U.S. PATENT DOCUMENTS 6,074,693 A * 6/2000 Manning ..... E01C 23/163 404/93
6,809,294 B2 10/2004 Velinsky
7,802,737 B2 9/2010 Rayner
7,850,101 B2 * 12/2010 Walmer ..... E01C 23/22 239/662
8,007,162 B2 8/2011 Rayner
10,168,714 B2 * 1/2019 Webber ..... E02F 9/2029
2021/0277613 A1 * 9/2021 Hendricks, Sr. ..... G05D 1/0094

FOREIGN PATENT DOCUMENTS

KR 2088600 B1 * 3/2020 ..... E01C 11/06

* cited by examiner

*Primary Examiner* — Gary S Hartmann

(57) ABSTRACT

A pavement joint sealing system that meters out an appropriate amount of sealant over potentially varying speeds and especially with potentially varying joint dimensions. Given the joint dimensions, the system is able to determine and enforce an effective ratio between the applicator speed and the sealant flow rate.

20 Claims, 5 Drawing Sheets

VEHICLE BASED JOINT SEALING SYSTEM

FIELD OF INVENTION

The present invention relates to devices for sealing seams in pavement.

BACKGROUND AND RELATED ART

Concrete is a commonly used surface covering material. For instance, sidewalks, warehouse floors, and some runways. In general, pads of concrete are poured separated by seams. These seams, or joints, allow the concrete pads to move without cracking. However, these joints must be sealed to prevent water from penetrating the joint and damaging the substrate. In the state of the art, joints are typically filled with a flexible sealant. In large applications, the sealant may be dispensed into the joint by a worker using a nozzle with a long handle and a large reservoir of sealant mounted either on the worker's body or in a cart. However, these methods can still be rather slow, as they may be limited both by the rate at which the operator can walk and by the rate at which the operator can accurately and consistently dispense the appropriate amount of sealant into the joint. What is needed is a system to efficiently and consistently apply sealant over a variety of joint dimensions over distance.

SUMMARY OF INVENTION

The present invention provides a system capable of sealing concrete joint seams in at least a semi-automated fashion. The system includes a vehicle with a control system that controls the flow of sealant and/or the rate of speed of the vehicle such that sealant is dispensed at an appropriate rate given the speed of the vehicle and the volumetric dimensions of the joint.

DETAILED DESCRIPTION

The present invention may be described in terms of a vehicle, a power package, and a sealant dispensing system. The power package may supply power to various components of the apparatus. The sealant dispensing system may comprise one or more sensors, one or more pumps, and a sealant dispensing head, and a sealant dispensing controller. The sealant dispensing controller may control the one or more pumps to dispense an appropriate amount of sealant in the joint.

Figure 1:
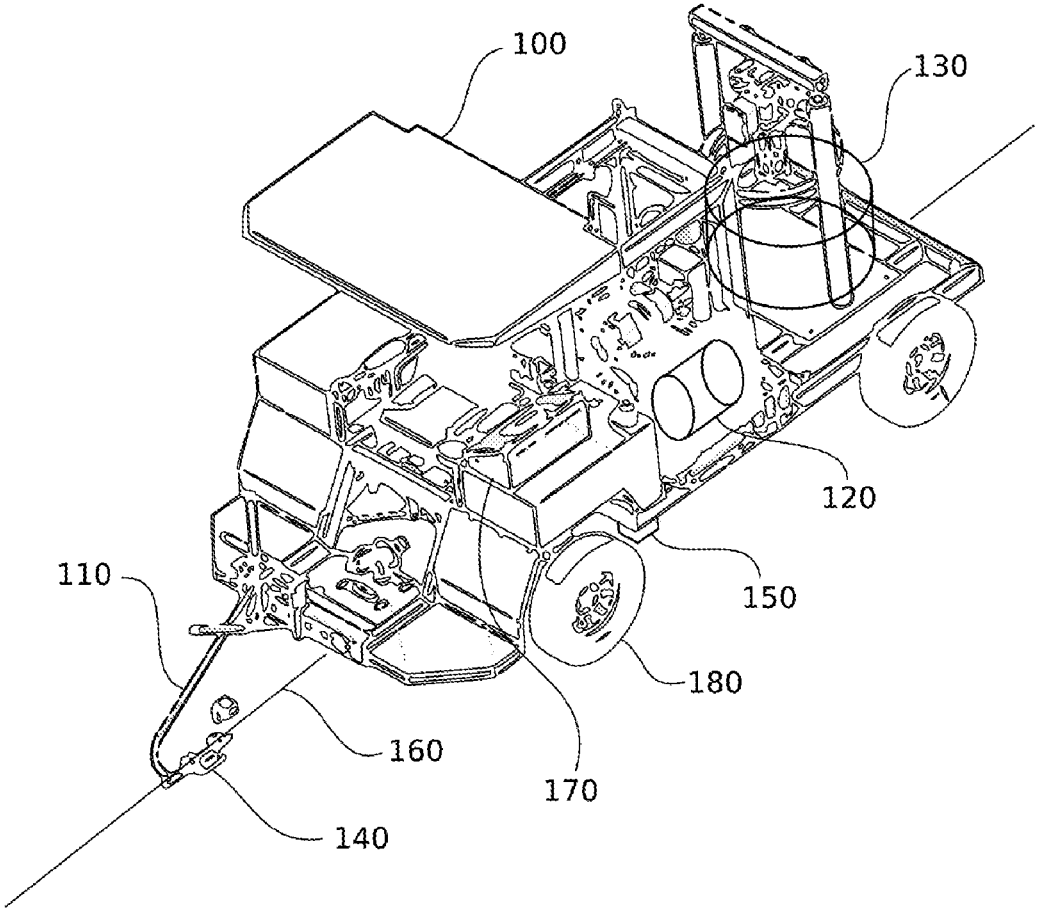
FIG. 1 is a view of a vehicle consistent with the present invention.

FIG. 1 shows a vehicle 100 consistent with the teachings of the present invention. As can be seen, the vehicle 100 has a sealant dispensing assembly 110 which has a pump 120, a sealant reservoir 130 and a sealant dispensing head 140. The vehicle shown in FIG. 1 has a sensor 150 mounted adjacent to a wheel 180 to precisely measure the vehicle's ground speed. As the vehicle 100 travels along the length of the pavement joint 160, a ratio controller 170 maintains an appropriate ratio between the flow of sealant through the dispensing head 140 and the speed of the vehicle 100 such that an effective amount of sealant is delivered into the pavement joint 160. The ratio controller 170 shown in FIG. 1 may increase or decrease the flow of the sealant through the dispensing head 140 by sending a signal to the pump 120 and or a valve mounted at the dispensing head 140, or both. In addition (or instead), the ratio controller might increase or decrease the speed of the vehicle by sending a signal to the drive system. In this way, the ratio controller 170 can maintain an appropriate ratio between the vehicle speed and the sealant flow rate to ensure the correct volume of sealant is dispensed over each length of the joint 160.

Figure 2:
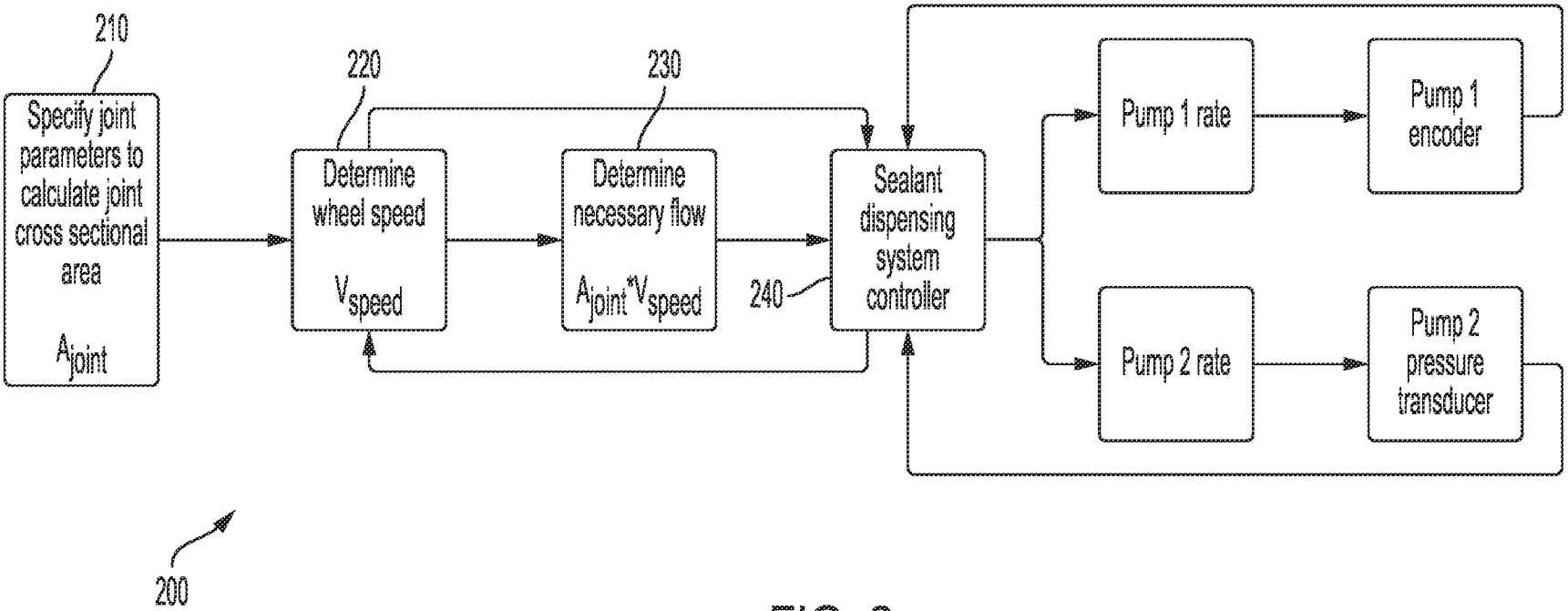
FIG. 2 is a diagram of the control loop.

FIG. 2 shows a diagram of a control loop 200 that can be used with the present invention. In a preferred embodiment, the ratio controller 170 receives (or specifies) joint parameters corresponding to a cross sectional area of the joint 210. Thereafter, the ratio controller obtains a speed reading 220 and uses the speed reading and the joint parameters to calculate an appropriate sealant flow rate 230. A dispensing controller sends signals to one or more pumps and/or valves 240 to control the dispensing and receives measurements pertaining to the actual flow. These measurements may be fed-back through the speed reading phase 220 to ensure the dispensing occurs as intended.

For the ratio controller 170 to attempt to optimize the flow rate, it is beneficial to have an accurate measurement of the vehicle's speed as well as sealant flow properties. The sealant dispensing system may comprise a wheel sensor to determine the speed at which the vehicle is travelling, and sensors at both pumps to determine the rate of output of the pumps. Ideally, the sealant dispensing system will control the output of the pumps such that the rate of dispensation into the joint is proportional to the vehicle speed, thus dispensing sealant in an even thickness. The scaling of this proportionality is, in turn, influenced by the dimensional parameters of the joint.

In some embodiments, a power package may be used to power pumps or other components. It should be understood that as used herein, power refers to energy in a general sense, not necessarily in the form of electricity. The power package may supply power to a power steering device, one or more air compressors, a generator, and any additional devices or elements requiring power.

Figure 3:
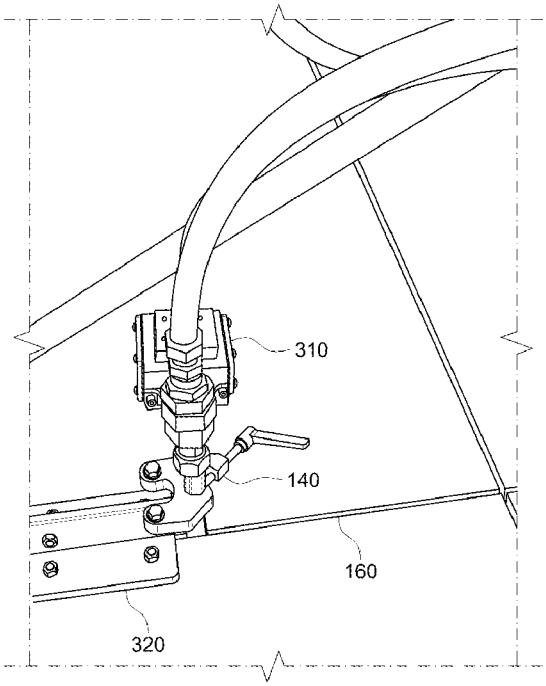
FIG. 3 is a view of a sealant dispensing assembly consistent with the present invention.

FIG. 3 shows a closer view of a sealant dispensing assembly 110. In this example, the sealant dispensing head 140 can be seen interacting with the joint 160. A plate 320 enables the dispensing nozzle to maintain a consistent distance from the pavement surface as the vehicle moves forward. Alternately, the distance between the head and the surface might be sensed and adjusted via an actuator. A sensor may be mounted on the head to detect joint parameters. This embodiment also shows the head mounted pump and/or valve 310 that can be used to meter out sealant more precisely than might be possible without head-mounted sensing and actuation.

In some embodiments, the power package drives a hydraulic pump, which in turn powers all other devices. The power package may operate on diesel, gasoline, liquefied petroleum gas, liquefied natural gas, electricity, or any combination of these or other energy sources. It may be preferable to employ different energy sources for different functions. For example, the power package may use a battery bank to power electric pumps 120, 310 for pumping sealant, and a gasoline engine to drive wheels 180. In a preferred embodiment, the device may have wheels 180 driven by one or more motors. Wheels may be driven by electric motors, hydraulic motors, internal combustion engines, or any other suitable power source. Pneumatic power may be required for one or more functions.

As previously described, the system will preferably compute or have available certain physical parameters of the joint 160 (for example, the cross-sectional area of the joint at a point in the length). Provided with the information of the cross-sectional area of the joint 180 at the nozzle, the control system is able to properly meter the sealant with respect to vehicle speed. Generally, the relationship between the volume of sealant needed and the dimensions of the section of joint will be as follows: area of cross section multiplied by length over which that area is consistent equals volume of sealant needed. An additional factor may be that a sealant may expand or contract some amount after application. This factor may be compensated for by applying a multiplier to the volume of sealant. Once the volume of sealant desired for a particular length of the joint is known, the joint can be effectively filled by ensuring that the correct amount of sealant flows into the joint as the vehicle drives along the joint's length. This further suggests a relationship between the rate of flow of the sealant from the nozzle and the speed of the vehicle. For example, it is easy to see how a constant flow rate coupled with an increased vehicle speed would result in a lower volume of sealant being applied to a fixed length of the joint. An object of the present invention is to ensure that the nozzle applies a desired volume of sealant to the joint, over potentially varying vehicle speeds and nozzle flow rates. The relationship between vehicle speed and sealant flow rate can be defined as: (volume of sealant needed over length) divided by (the amount of time vehicle takes to traverse the length) equals (approximation of desired flow rate in volume per time unit). With this information, the sealing system can manage the relationship between the dimensions of the joint, speed of the vehicle, and the nozzle flow rate by automatically adjusting the vehicle speed or the sealant flow rate within an operational range to ensure precise application of sealant to fill the joint 160.

In some embodiments, this area may be conferred to the control system by inputting the width and depth of the joint, assuming a rectangular joint profile. In some embodiments, the control system may be preconfigured with the parameters for certain standardized joint configurations. The operator may select one of these standard joints without the need to specify the parameters directly.

Such control systems may utilize proportional-integral-derivative (PID) control loops to continuously adjust the controlled device. In general, PID controllers use measurements of a process variable to update the controlled device to maintain the output of the device at a desired point.

It should be understood that, as used throughout this specification, measuring a quantity may indicate measuring a proxy for that quantity. For example, the speed of a vehicle may be measured by measuring the rotations per minute of the wheels, given a particular tire diameter. Similarly, the volumetric output of a pump may be measured by measuring the frequency of a pump, given a fixed volume per cycle. Measurements of quantities in this manner are well-known in the art, and one of typical skill would be capable of choosing a suitable means of measuring the desired quantities via a proxy.

In a preferred embodiment, the apparatus employs a sealant control system to control the one or more pumps to dispense sealant in a desired manner. The sealant may be dispensed in a manual mode. An operator can control the rate of sealant dispensing by manipulating a joystick or other controller. In this case, the set point for the PID control is specified by the operator. In other embodiments, the sealant may be dispensed in an automatic mode. Here, the sealant control system adjusts the rate of sealant dispensing in correspondence with the speed of the apparatus. The control system may utilize a continuously measured vehicle speed to determine the rate at which sealant must be dispensed. The rate is the set point for the control system, and may be continuously updated with each iteration of the PID control loop. The control system may utilize measurements of the rate at which one or more pumps are moving sealant. These variables represent the inputs to the control loop. The output relays an update to the pump or pumps which must be made in order to maintain the appropriate sealant flow rate. In another embodiment, the sealant may be dispensed at a particular rate and the speed of the vehicle may be modulated to deliver the requisite volume of sealant per length. For example, if the sealant is being dispensed at 1 cubic meter per minute and the joint parameters are such that a cubic meter of sealant would fill 30 meters of the joint appropriately, the speed of the vehicle might be appropriately set to move forward 30 meters within the minute. In another embodiment, the rate of sealant dispensation and speed may both be continuously modified by the control system.

Sensors may enable the functions of the various control systems. A ground speed sensor may enable the sealant control system to dispense sealant in a rate proportional to the ground speed. A ground speed sensor may operate using any technology suitable to determine the speed of the vehicle with reasonable accuracy. What constitutes reasonable accuracy is primarily determined by the tolerances in joint consistency deemed appropriate by the operator of the apparatus. For example, the sensor may use GPS, measure the rotation speed of the wheels including by an encoder, use an optical sensor with respect to the ground, and so on. The apparatus may comprise one or more sensors for determining the rate of operation for one or more pumps. Such sensors may be pressure transducers, encoders, or any other sensor which can enable the determination of the volume per time at which said pump is moving sealant. The suitability of sensor designs is at least partially determined by the means by which power is delivered to the device in question.

Several pumps may be employed within the system. The choice of number of pumps, as well as the choice of types of pumps, may come with advantages and disadvantages. A single pump enables a simpler control system. However, a single pump may not be able to efficiently move sealant in cases where the sealant reservoir cannot be positioned sufficiently close to the sealant dispensing head. Many pumps are known in the art. A person skilled in the art of mechanical engineering and fluid flow controls would understand the advantages and disadvantages of these various pumps, and which types of pumps are most suitable for this application. The pump or pumps may include piston pumps and gear pumps.

In one embodiment, the invention comprises two pumps. In use, a sealant reservoir is mounted on or attached to the vehicle 100. A sealant pump head may be mounted such that it may pull sealant from the sealant reservoir 130. This first sealant pump may push sealant through a network of flexible and rigid tubes or hoses, to a second pump 310. This second pump 310 may then draw sealant out of the sealant dispensing head 140 into the joint.

The sealant dispensing head 140 may have a valve, for example, a pneumatically operated ball valve. Such a valve may be advantageous in enabling the flow of sealant to be stopped at the dispensing head. This can prevent sealant from being released as soon as the joint is completed and can prevent residual pressure from causing sealant to leak.

The apparatus may use a human interface to enable the apparatus operator to interact with the control system. In some embodiments, the human interface may be a touch screen. The human interface may be chosen such that an operator can use said interface to select actions relating to the operation of the device, such as selecting a desired speed. The interface may also enable an operator to input necessary joint parameters. In some embodiments, the interface may comprise an LED screen, number pad, a keyboard, a mouse, or a combination of these. In some embodiments, the human interface may connect with the control system via a wireless connection, such as Bluetooth. In some embodiments, the human interface may comprise an application on a phone or tablet.

The apparatus may be operated in a manual mode with respect to steering. The apparatus may have a steering input device, such as a joystick, a wheel, or any other suitable device for relaying steering input by an operator. Such a mode may be used both while using the apparatus to seal a joint or to transport the apparatus to a location. Steering of the apparatus may be achieved by any suitable mechanism, such as a rack and pinion or linkage steering. In some embodiments, hydraulic steering may be used. In a hydraulic steering system, the steering input device may comprise a potentiometer connected to a pump. A hydraulic steering system may comprise a PID controller.

In some embodiments, joint parameters can be obtained or detected automatically. For example, a camera can be used to measure the width and depth of the joint. Recent advances in the field of photogrammetry have demonstrated that it is possible to obtain very accurate measurements by inferring geometry from a series of images. Alternatively (or in combination) a laser measuring device, linear actuator, emitter and microphone array or other measuring system can be used. Many may be suitable for this application, and the examples provided here are illustrative in purpose and not intended to be exhaustive. It is understood that the ratio controller has an interface to receive the parameters that have been detected or otherwise provided. Such an interface may, for example, take the form of a physical interface to a storage device or a wired or wireless communication interface to a sensor or data store, regardless of the specific mechanisms used to obtain the parameters.

It is important to note that joint parameters may be determined in advance and or separately from the vehicle. In some embodiments, accurate measurements can be obtained in advance and recorded for later use by the sealing vehicle. For example, a drone 510 could be used to fly over the length of the joint(s) and quickly and/or meticulously measure the joint dimensions at multiple sample points 520. The measurements obtained can be associated with location data obtained from a global positioning system system or even associated with localized landmarks or markings that can later be recognized at the sealing vehicle. Such an arrangement might provide additional flexibility and cost savings as it would no longer be necessary to maintain potentially sensitive measuring equipment on the vehicle 100 itself. The joint measuring and sealing application functions could be managed independently provided the measuring occurs before the application.

Figure 4:
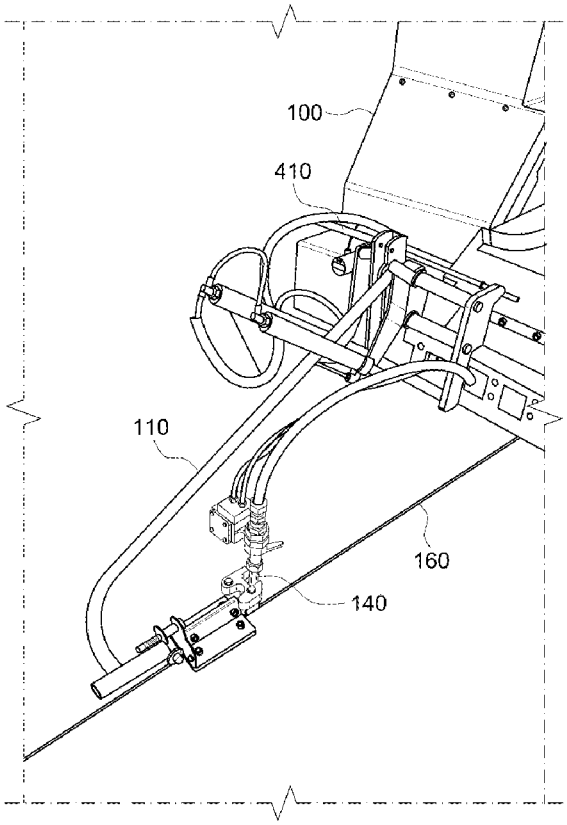
FIG. 4 is a view of an auto-steering system as part of the present invention.

FIG. 4 shows a view of the sealant dispensing assembly 110 with a steering function. Here a tab located at the dispensing head 140 tracks along the joint as the vehicle 100 moves. Lateral deviations from either the joint 160 or the vehicle 100 may be detected by an auto steer system 410 which can adjust the vehicle to restore alignment with the joint. In this way, some embodiments may incorporate an automatic steering function. Preferably, this function would be activated using the human interface. An auto-steer system 410 may rely on the position of the joint with respect to the apparatus in order to steer the apparatus. Steering in this fashion allows the sealant dispensing head to maintain a position with respect to the joint that allows sealant to be properly dispensed into the joint.

While the example depicted shows a tab that tracks the joint 160, this positional relationship may be determined by a number of mechanisms. In some embodiments, a camera positioned such that the joint is captured in the image may be used to provide this feedback. In some embodiments, the apparatus may comprise a device which is positioned within the joint during sealant dispensing. During operation, if this device makes contact with either side of the joint, the auto-steer system 410 may apply an appropriate correction to the steering to maintain the sealant dispensing head's position with respect to the joint. The device may be any suitable mechanism in which the physical contact can be translated into an electronic signal. In some embodiments, this device may be a fin mounted on the sealant dispensing head but free to slide along perpendicularly to the length of the joint, comprising a linear encoder to measure the degree of steering correction needed. In some embodiments, this device may be used as part of an automatic joint sizing system. The auto-steer system may comprise a PID controller.

In some embodiments, the position of the sealant dispensing head 140 may be controllable independent of the vehicle as a whole. In this case, the operator may be required only to maintain the apparatus in an approximate position with respect to the joint, and the head may move independently to remain centered in the joint. The position of the head may be controlled in a fashion similar to the system described for automatic steering, using a similar position sensor.

Figure 5:
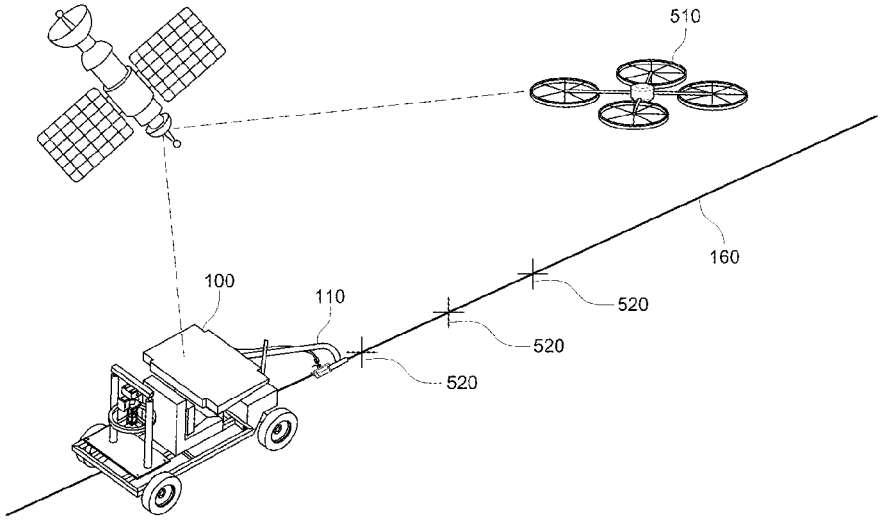
FIG. 5 shows a remote sensing embodiment of the inventive apparatus.

FIG. 5 shows an example of a system integrating a vehicle 100 as described herein, with a drone 510 or other joint parameter sensing component that might be separated from the vehicle in space and/or time. Here, we can see that the primary requirement is that the parameters are measured/computed at points along the joint 520 before the vehicle arrives at the points 520 and that the data is available to associate with the appropriate length of the joint when the vehicle 100 arrives. The example discussed above uses a global positioning system for association but it should be understood that many other suitable methods for making this association can be made including surface or adjacent feature detection via a range of visual, audio, radio magnetic and other cues.

The speed of the vehicle may be controlled by an operator. In embodiments in which the wheels 180 of the apparatus are driven, the speed may be controlled using an input device, such as a joystick, a dial, a pedal, or any other suitable mechanism. The speed may be controlled continuously or in discrete increments. Speed may be preselected by the operator and controlled by the machine. For example, a speed may be selected, then that speed may be maintained by a speed control system. The speed of the vehicle may be regulated by the control system such as to stay within operable limits for the pump system. That is, the speed may be governed to remain under a maximum defined by the rate at which sealant can be delivered. A minimum speed may be similarly defined. Maximum speed may also be governed for reasons such as workplace safety, precision of the sealant delivery, and so on. Maximum speed may be a factor of the specifics of the application, such as curvature of the joint, type of sealant used, and so on. A speed control system may utilize the same wheel speed data stream that is used by the sealant control system. The speed control system may apply corrections to the wheel speed based on a PID loop, using whichever power package is used to power the wheels. A speed may be selected using the human interface. The speed control of the apparatus may comprise a deadman's switch, as a safety feature.

One or more tanks may need to be incorporated into the inventive design. In some embodiments, where the power package of the apparatus requires liquid fuel, such as diesel, gasoline, LPG or LNG, a tank may be used to store said fuel. In some embodiments, wherein one or more elements are hydraulic-powered, a tank may be used to store said hydraulic fluid. A tank 130 may also be used to store sealant.

In some embodiments, the apparatus may be arranged as a cart. In this embodiment, the one or more wheels may or may not be powered by the power package. In an embodiment where the wheels are not driven, the operator may push the cart. Such an embodiment may be advantageous in areas where a larger machine is less practical.

The vehicle platform may have any number of wheels, tracks, skids or other components for moving around and maintaining the desired distance from the joint or surface being treated.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

I claim:

1. A pavement joint sealing system comprising:

a vehicle configured to move relative to a ground surface at a ground speed;

a sealant dispensing assembly configured to dispense a flow of sealant at a sealant volume flow rate, wherein said sealant dispensing assembly comprises at least one pump, at least one sealant reservoir, and a sealant dispensing head;

at least one sensor operable to measure the ground speed of the vehicle; and a ratio controller configured to:

receive or determine joint parameters corresponding to a cross-sectional area of a pavement joint, calculate a target volume of sealant per unit length of the pavement joint based on the joint parameters, and control at least one of: the speed of said vehicle and the sealant volume flow rate to cause the target volume of sealant per unit length to be dispensed into the pavement joint as said vehicle travels along said pavement joint.

2. The pavement sealing device of claim 1, wherein said ratio controller further comprises an interface through which said parameters are received.

3. The pavement sealing device of claim 1, wherein said sealant dispensing assembly comprises a first pump coupled to said sealant reservoir and a second pump coupled to said sealant dispensing head.

4. The pavement sealing device of claim 1, wherein a position of said sealant dispensing head is controllable for motion with respect to the vehicle along at least one axis by at least one actuator and at least one of a second controller or the ratio controller.

5. The pavement sealing device of claim 1, wherein said at least one sensor operable to determine the ground speed of the vehicle is an encoder which measures a rotational speed of at least one wheel of the vehicle.

6. The pavement sealing device of claim 1, further comprising an automatic steering system, wherein said automatic steering system comprises at least one means for sensing a position of said sealant dispensing head with respect to said pavement joint; and At least one controller operable to affect at least one of:

The trajectory of said vehicle; and

The position of said sealant dispensing head with respect to the vehicle.

7. The pavement sealing device of claim 6, wherein said sensing means of the automatic steering system comprises:

an electronic measuring device mounted on said sealant dispensing assembly primarily ahead of the sealant dispensing head.

8. The pavement sealing device of claim 6, wherein said sensing means of the automatic steering system comprises at least one camera.

9. The pavement sealing device of claim 1, further comprising an automatic vehicle speed control system, operable to maintain the speed of the vehicle at a given rate.

10. The pavement joint sealing system of claim 1, further comprising a joint sensor configured to detect data corresponding to the joint parameters, wherein the ratio controller is further configured to receive the joint parameters from the sensor.

11. The pavement joint sealing system of claim 1, further comprising a second vehicle separate from the vehicle and having a joint sensor configured to detect data corresponding to the joint parameters, and a communication system configured to transmit at least one of the data corresponding to the joint parameters and the joint parameters to the ratio controller.

12. The pavement joint sealing system of claim 1, further comprising an automatic steering system having:

a tab configured to be positioned within the pavement joint while the vehicle is traveling the pavement joint and to detect movement of the sealant dispensing head relative to the pavement joint; and a steering controller coupled to the tab and configured to adjust a trajectory of the vehicle based on the detected movement of the sealant dispensing head relative to the pavement joint.

13. A method for dispensing sealant by a vehicle, the method comprising:

receiving, by a controller, cross-sectional dimensions of a joint;

calculating, by the controller, a target volume of sealant required per unit length based on the cross-sectional dimensions of the joint; and repeatedly, by the controller:

measuring a ground speed of a dispensing vehicle;

measuring a flow rate of sealant; and modifying at least one of the flow rate of sealant and the ground speed of the dispensing vehicle such that said target volume of sealant per unit length is dispensed.

14. The method of claim 13, wherein the flow rate of sealant is modified by adjusting a throughput of at least one pump to maintain the specified joint dimensions.

15. The method of claim 13, further comprising changing, by the controller, the ground speed of said dispensing vehicle to enable an appropriate volume of sealant to be dispensed over a length of the joint over which said cross-sectional dimensions are variable.

16. The method of claim 13, further comprising:

detecting, by a joint sensor, data corresponding to the cross-sectional dimensions of the joint; and calculating, by the controller, the cross-sectional dimensions of the joint based on the data corresponding to the cross-sectional dimensions of the joint.

17. The method of claim 13, further comprising:

detecting, by a tab positioned within the joint, movement of a sealant dispensing head relative to the joint; and adjusting, by the controller or a steering controller, a trajectory of the vehicle based on the detected movement of the sealant dispensing head relative to the joint.

18. A system comprising:

a vehicle configured to move relative to a ground surface at a ground speed;

a sealant dispensing assembly coupled to the vehicle and configured to dispense a flow of sealant at a sealant volume flow rate;

at least one sensor configured to measure the ground speed of the vehicle;

a tab configured to be positioned within a pavement joint while the vehicle is traveling along the pavement joint and to detect movement of the sealant dispensing assembly relative to the pavement joint; and a controller coupled to the vehicle and the sealant dispensing assembly and configured to:

receive or determine joint parameters corresponding to a cross-sectional area of the pavement joint, calculate a target volume of sealant per unit length of the pavement joint based on the joint parameters, control at least one of: the speed of said vehicle and the sealant volume flow rate to cause the target volume of sealant per unit length to be dispensed into the pavement joint as the vehicle travels along the pavement joint, and adjust a trajectory of the vehicle based on the detected movement of the sealant dispensing assembly relative to the pavement joint.

19. The system of claim 18, further comprising a joint sensor configured to detect data corresponding to the joint parameters, wherein the controller is further configured to receive the joint parameters from the sensor.

20. The system of claim 18, wherein the sealant dispensing assembly includes a first pump coupled to the sealant reservoir and a second pump coupled to the sealant dispensing head, and wherein the controller is further configured to adjust a pump speed of the first pump and a pump speed of the second pump to control the sealant volume flow rate.

* * * * *